US012515766B1

(12) United States Patent
Miller et al.

(10) Patent No.: US 12,515,766 B1
(45) Date of Patent: Jan. 6, 2026

(54) WAKE SCALING FOR WATERSPORTS BOATS AND RELATED DEVICES AND METHODS

(71) Applicant: Correct Craft IP Holdings, LLC, Orlando, FL (US)

(72) Inventors: Eric J. Miller, Orlando, FL (US); Adam C. Greer, Orlando, FL (US)

(73) Assignee: CORRECT CRAFT IP HOLDINGS, LLC, Orlando, FL (US)

( * ) Notice: Subject to any disclaimer, the term of this patent is extended or adjusted under 35 U.S.C. 154(b) by 631 days.

(21) Appl. No.: 17/935,604

(22) Filed: Sep. 27, 2022

Related U.S. Application Data

(63) Continuation of application No. 17/006,980, filed on Aug. 31, 2020, now Pat. No. 11,459,069.

(60) Provisional application No. 62/893,922, filed on Aug. 30, 2019.

(51) Int. Cl.
*B63B 34/75* (2020.01)
*B63B 79/40* (2020.01)

(52) U.S. Cl.
CPC ..... *B63B 34/75* (2020.02); *B63B 79/40* (2020.01)

(58) Field of Classification Search
CPC ..... B63B 34/75; B63B 79/40
See application file for complete search history.

(56) References Cited

U.S. PATENT DOCUMENTS

| | | | | |
|---|---|---|---|---|
| 4,958,585 | A | 9/1990 | Caldwell, Jr. | |
| 6,012,408 | A * | 1/2000 | Castillo | B63B 39/061 114/274 |
| 8,261,682 | B1 | 9/2012 | DeVito | |
| 10,822,055 | B2 | 11/2020 | Sheedy et al. | |
| 2013/0228115 | A1 | 9/2013 | Gasper et al. | |

FOREIGN PATENT DOCUMENTS

WO WO03093102 11/2003

OTHER PUBLICATIONS

MasterCraft Boat Company, LLC "MasterCraft XT22" Copyright Registration No. DVH 1926; Nov. 8, 2018; pp. 16.
MasterCraft Boat Company, LLC "2018 MasterCraft XStar" Copyright Registration No. DVH 1928; Nov. 8, 2018; pp. 55.
Jake Peerson "MasterCraft XT22—2018" Futrell Marine https://www.youtube.com/watch?v=T-4JoNTwS0E&t=95s 2018.

* cited by examiner

*Primary Examiner* — Stephen P Avila
(74) *Attorney, Agent, or Firm* — Allen, Dyer, Doppelt Gilchrist, PA

(57) ABSTRACT

A watersports boat offering improved wake scaling includes a hull having a static flow plane and an operating plane separated by an operating angle, rear corners of the hull each defining a distinct transition from a respective side of the hull to a transom of the hull. A shape of the outer perimeter of the hull along the operating plane includes a pair of outward curves, each outward curve curving away from a hull centerline moving forwardly of a respective one of the rear corners of the hull.

19 Claims, 6 Drawing Sheets

Fig. 9B
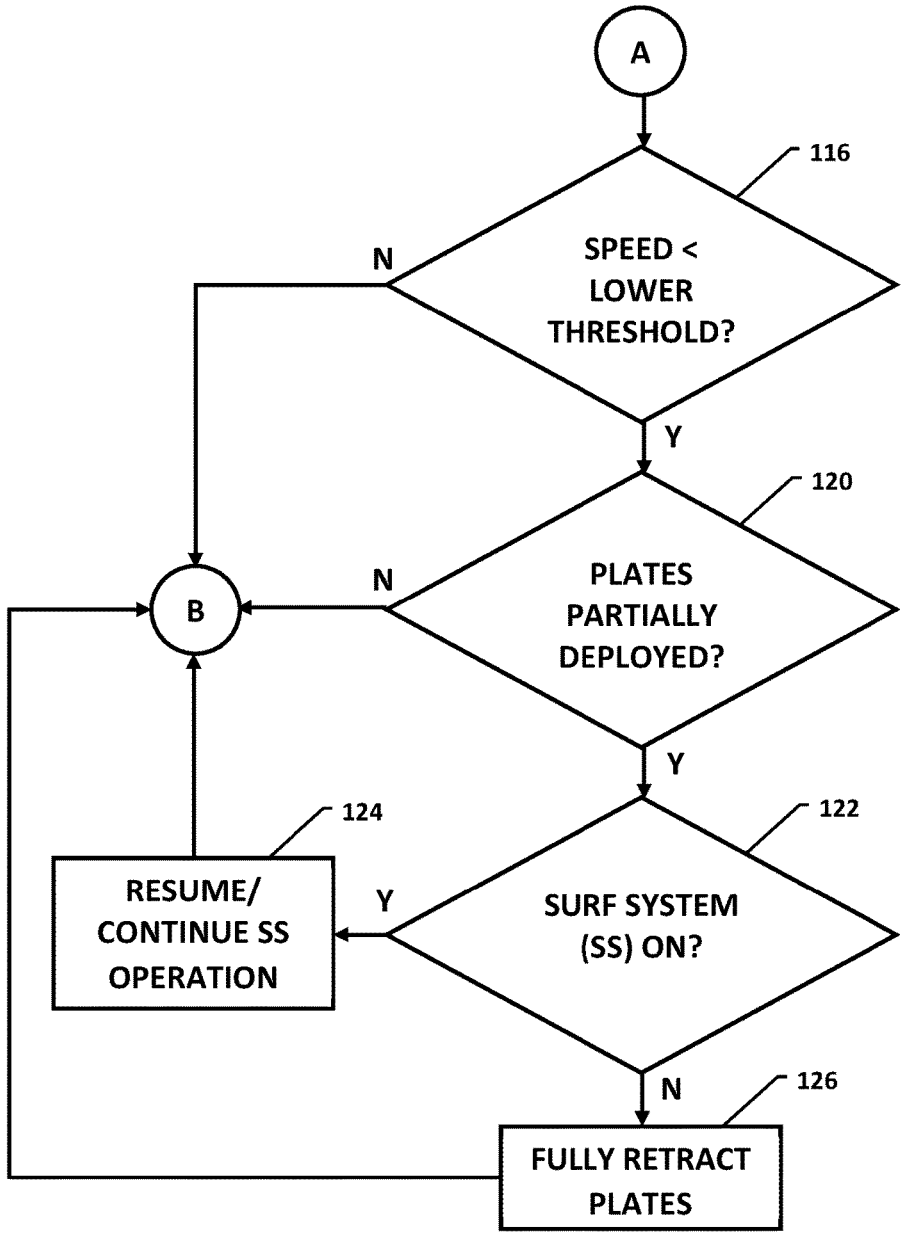
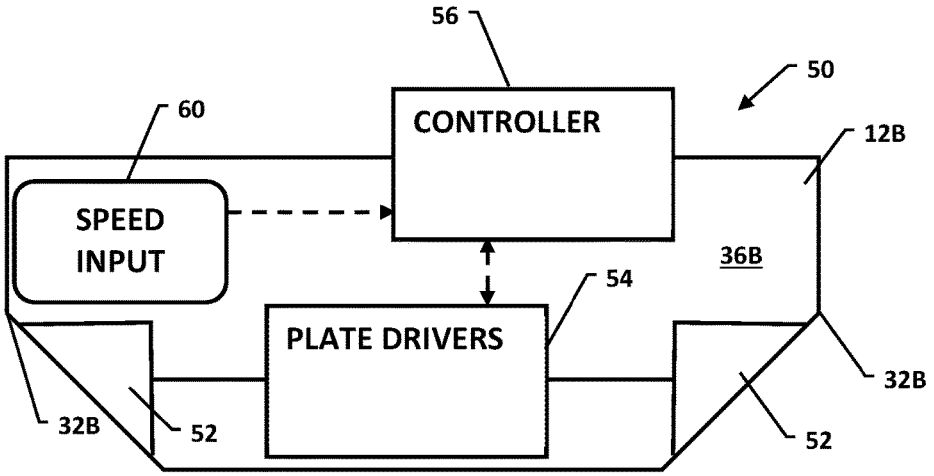
Fig. 5

WAKE SCALING FOR WATERSPORTS BOATS AND RELATED DEVICES AND METHODS

CROSS-REFERENCE TO RELATED APPLICATION

This application is a continuation of U.S. Non-Provisional application Ser. No. 17/006,980 filed on Aug. 31, 2020, which claims the benefit of U.S. Provisional Patent Application Ser. No. 62/893,922 filed on Aug. 30, 2019, the contents of which are herein incorporated by reference in their entirety.

FIELD OF THE INVENTION

The present invention relates to watersports boats, and more particularly, to optimizing wake properties for wakesurfing.

BACKGROUND OF THE INVENTION

Wakesurfing, where a rider surfs a boat's wake without being pulled directly by the boat (e.g., via tow rope), has grown rapidly in popularity. As a result, there have been several improvements to watersports boats specifically designed to improve wake characteristics for surfing. For example, ballasting systems exist which add additional weight to the boat to improve wake size. Many such systems will allow selection of a preferred side for surfing and add additional ballast on that side. Other surf wake enhancement systems place a movable plate into the path of water traveling along a selected side to further enhance the wake on that side or, depending on system design, the opposite side.

Such systems have been successful at producing boat wakes having properties more like traditional surfing waves, where the wake features a zone with a stable, well-defined face. On a suitably configured watersports boat, a wake suitable for surfing will generally form around 10 miles per hour (mph). Some surfers prefer to wakesurf at higher speeds up to 12.5 or 13 mph. Ideally, the only difference between wake properties as speed increases are proportional increases in the speed and size of the wake. In reality, however, hydrodynamic properties of the boat hull cause changes to the shape of the wake as speed changes over this range, and not merely scaled changes in speed and size.

SUMMARY OF THE INVENTION

In view of the foregoing, it is an object of the present invention to provide a watersports boat having improved wake scaling properties, together with associated systems and methods.

According to an embodiment of the present invention, a watersports boat offering improved wake scaling includes a hull having a static flow plane and an operating plane separated by an operating angle, rear corners of the hull each defining a distinct transition from a respective side of the hull to a transom of the hull. A shape of the outer perimeter of the hull along the operating plane includes a pair of outward curves, each outward curve curving away from a hull centerline moving forwardly of a respective one of the rear corners of the hull.

According to an aspect of the present invention, each of the outward curves has a length, moving forwardly of the respective one of the rear corners, of at least 8 inches.

According to another aspect, the watersports boat further comprises a surf system including a pair of plates, each of the plates being extendable and retractable from the transom past the respective one of the rear corners, a respective driver operable to extend and retract each of the plates, and a controller operable to control the drivers to extend and retract each of the plates. The controller receives a speed input and is configured with program instructions to automatically partially deploy both the plates when the speed input indicates a boat speed is in excess of an upper speed threshold.

According to a method aspect, a method of improving wake scaling for watersports comprises including, in a shape of an outer perimeter of a hull of the watersports boat moving forwardly of each rear corner of the hull marking a distinct transition from the transom to a respective side of the hull, a respective outward curve which curves away from a hull centerline.

These and other objects, aspects and advantages of the present invention will be better appreciated in view of the drawings and following detailed description of preferred embodiments.

BRIEF DESCRIPTION OF THE DRAWINGS

FIG. 5 is schematic diagram of a control system for a surf system usable with the watersports boat of FIG. 1;

FIGS. 9A and 9B are a logic flow diagram of certain operations of the surf system of FIG. 5.

DETAILED DESCRIPTION OF PREFERRED EMBODIMENTS

Figure 1:
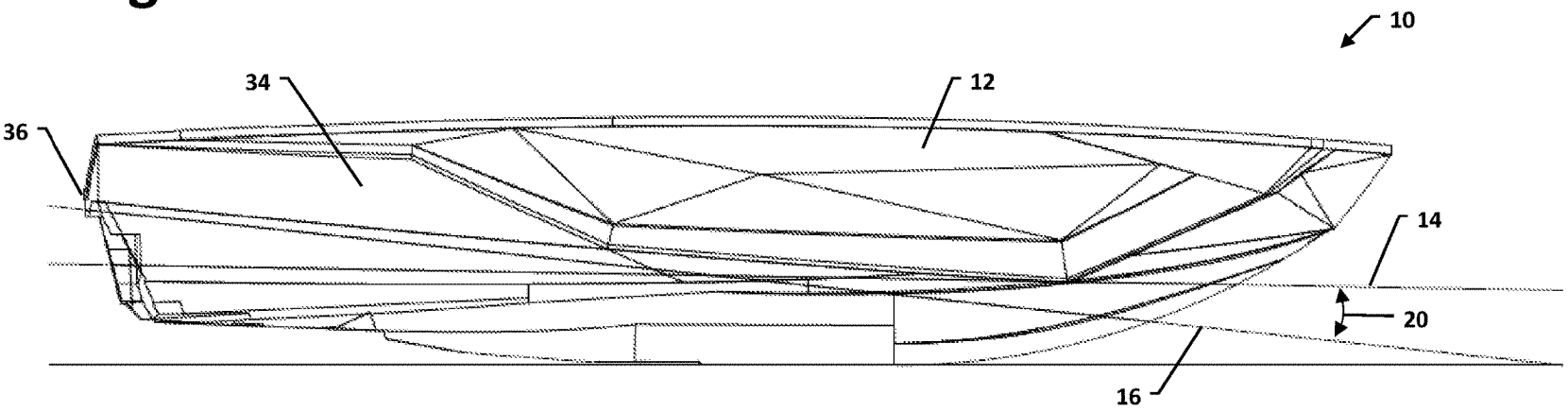
FIG. 1 is a side view of a watersports boat hull, with a static flow plane and an operating plane identified thereon.

According to an embodiment of the present invention, referring to FIG. 1, a watersports boat 10 includes a hull 12 having a static flow plane 14 and an operating plane 16 separated by an operating angle 20. The static flow plane 14 represents the nominal waterline of the hull 12 when not in motion. The operating plane 16 represents the nominal waterline of the hull 12 when moving forward through the water.

While the static flow and operating planes 12, 14 and the operating angle 20 will between watersports boats depending on hull design, they are readily discernible values for any given hull. A preferred operating angle 20 is at least approximately 3-5 degrees, and more preferably between approximately 6 to 8 degrees, although the present invention is not limited to watersports boats with hulls having operating angles within this range.

Figure 2:
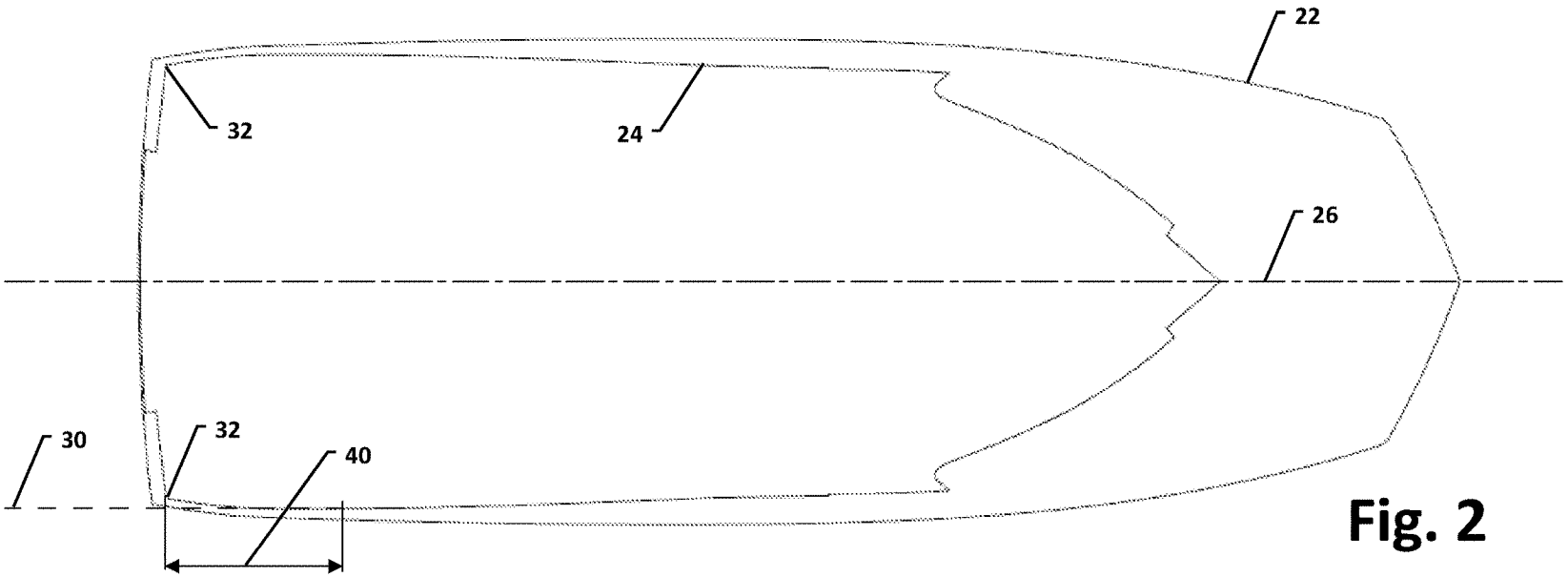
FIG. 2 includes overlying plan views of the watersports boat hull taken along the static flow plane and the operating plane, respectively.

In FIG. 2, the shape of the outer perimeter of the hull 12 along the static flow plane 14 is represented by the outline 22. The shape of the outer perimeter of the hull 12 along the operating plane 16 is represented by the outline 24. The hull centerline 26 and reference line 30 are parallel. As can be appreciated, along the operating plane 20, the shape of the outer perimeter of the hull 12 curves away from the centerline 26 (and towards parallel reference line 30) moving forwardly of rear corners 32. Rear corners 32 mark a distinct transition from sides 34 to a transom 36 of the hull 12—as opposed, for instance, to a hull having a rounded stern.

The outward curve facilitates water flow along the operating plane 20 of the hull 12 approaching and passing the rear corners 21 in a manner that enhances surf wake formation at lower wake surfing operating speeds. Consequently, scaling of the wake shape across wake surfing operating speeds is improved. A length 40 of the outward curve forward of each of the rear corners 32 in the depicted embodiment is preferably greater than approximately 8-12 inches, more preferably greater than 18 inches, and most preferably between approximately 20 to 21 inches. It will be appreciated that specific dimensions of the outward curve can be optimized for any given watersports boat hull.

Figure 3:
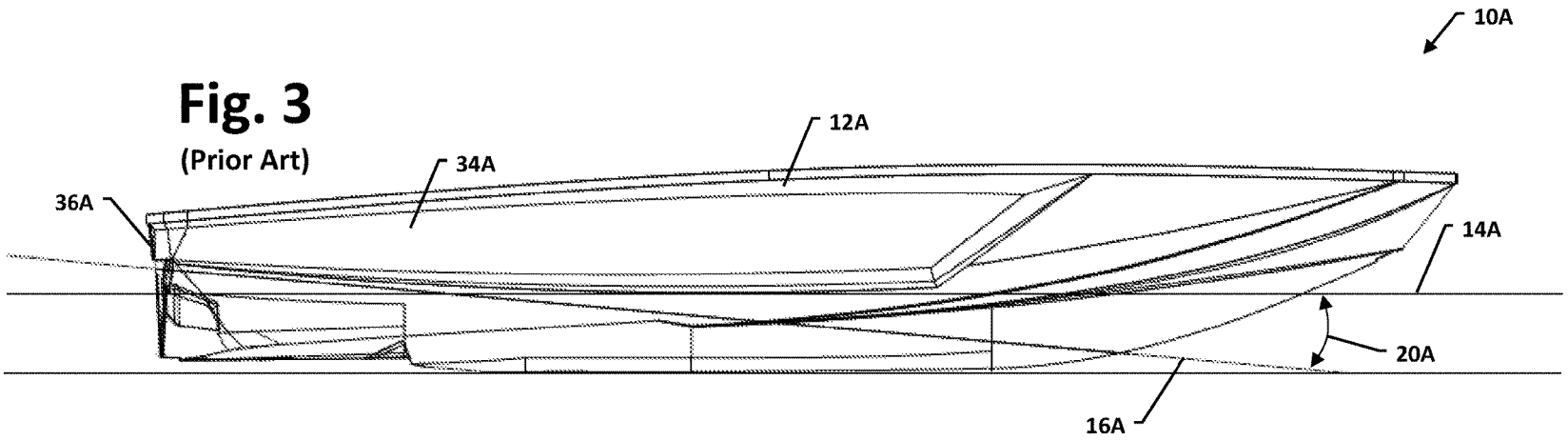
Fig. 3 (Prior Art)
FIG. 3 is a side view of a prior watersports boat hull, with a static flow plane and an operating plane identified thereon.
Figure 4:
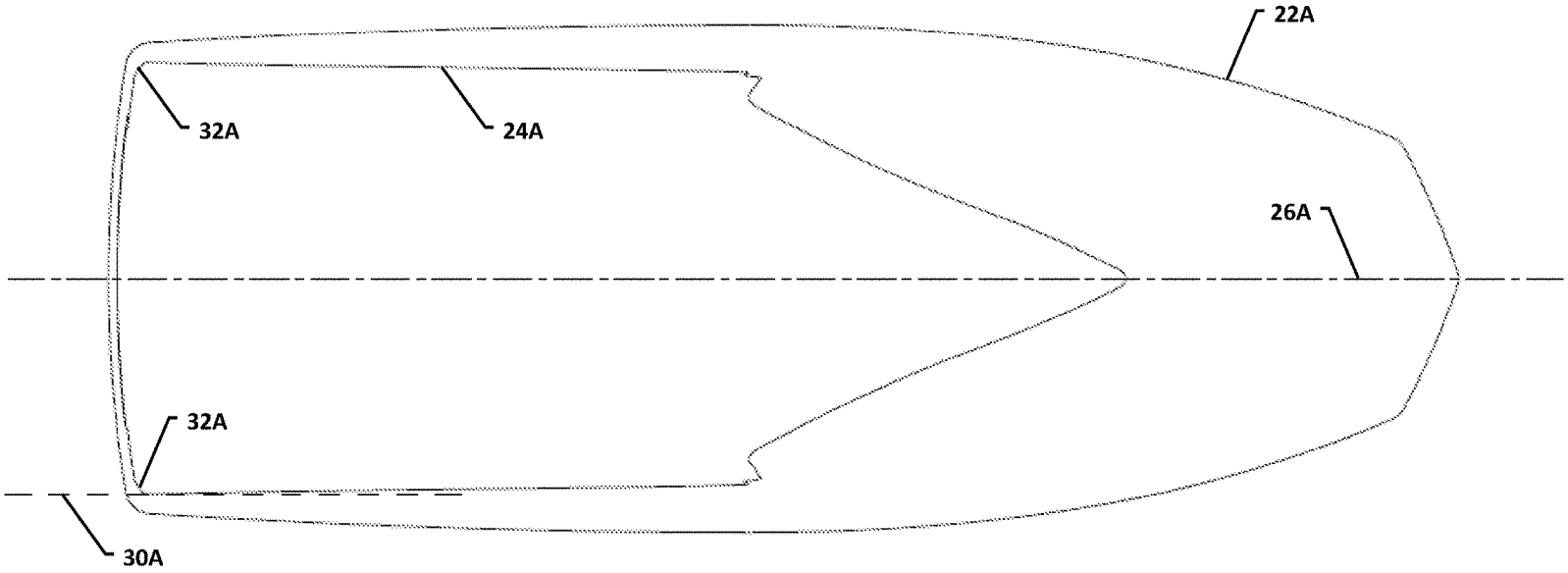
FIG. 4 includes overlying plan views of the watersports boat hull taken along the static flow plane and the operating plane, respectively.

To better appreciate the hull shape described above, referring to FIG. 3, a prior watersports boat 10A has a hull 12A with static flow and operating planes 14A, 16A separated by an operating angle 20A. In FIG. 4, the differing shapes of the hull 12A along the static flow and operating planes 14A, 16A are represented by outlines 22A, 24A, respectively. It will be appreciated that, forwardly of the rear corners 32A, the shape of the outer perimeter of the hull 12A along the operating plane 14A curves toward the centerline 26A (and away from the parallel reference line 30A) forward of the rear corners 32A.

Referring to FIG. 5, watersports boats like the boat 10 are often equipped with a surf system 50. The surf system 50 includes plates 52 which are extendable and retractable from a transom 36B past rear corners 32B of the hull 12B. The plates 52 are mechanically driven by drivers 54 under direction from a controller 56. Any programmable microprocessor device can be used for the controller 56. When used for surfing, a user selects a side of the boat to surf and the controller 56 operates one of the drivers 54 to fully extend the plate 52 on the selected side, which enhances wake properties for surfing.

The controller 56 also receives a speed input 60. The speed input 60 reflects boat speed, and various means can be utilized to generate the speed input. For instance, the speed input can be generated as a function of engine and/or shaft rotational speed. Alternately, the speed input can be generated by directly sensing speed through the water, or by using data from GPS (global positioning system) or another navigational system.

Figure 6:
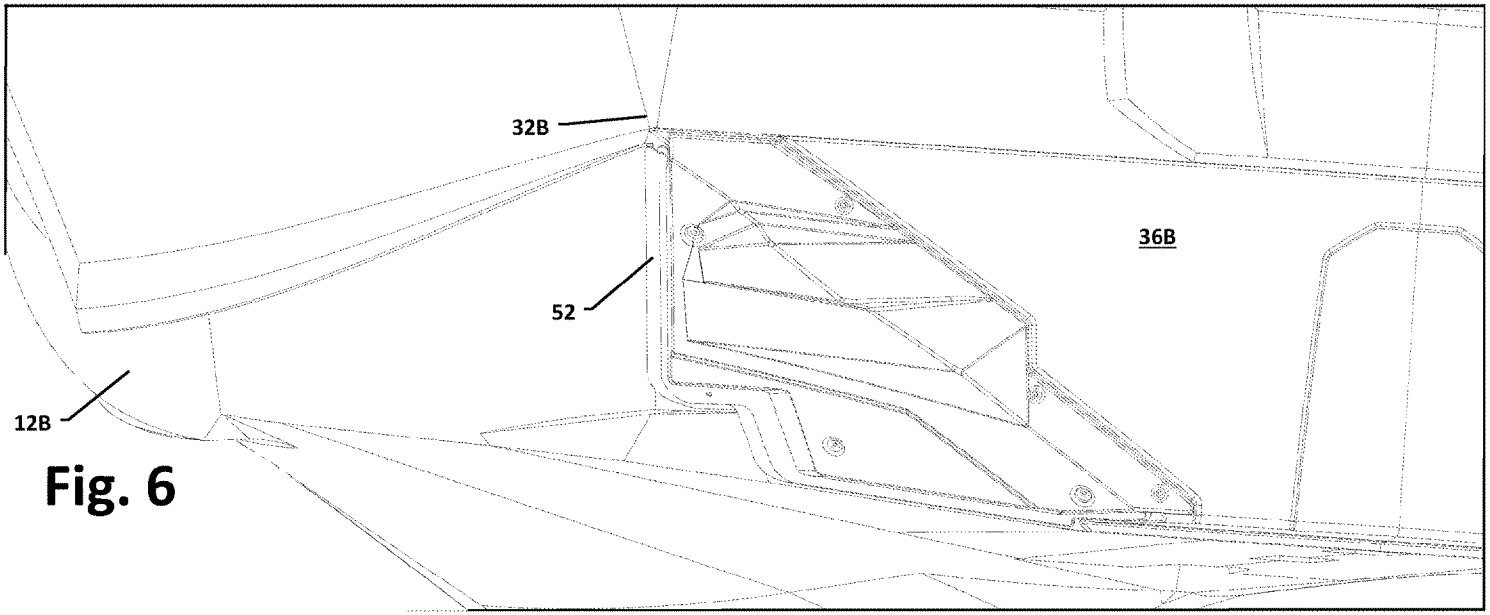
FIG. 6 is rear quarter view of a portion of a watersports boat hull, including a surf system with a plate thereof partially deployed.
Figure 7:
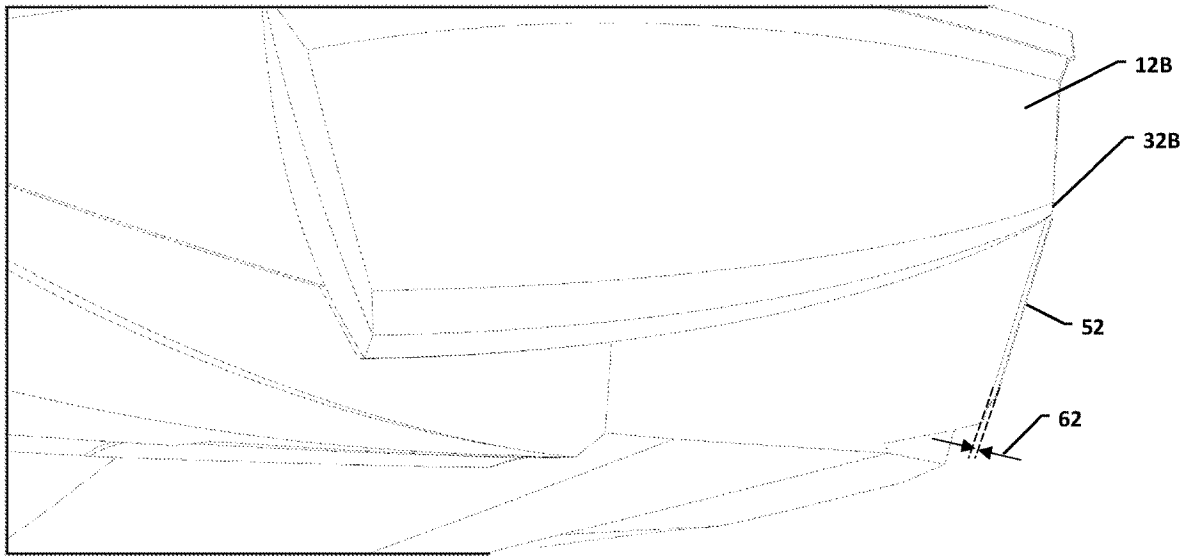
FIG. 7 is a front view of the rear quarter of FIG. 5, with the plate of the surf system partially deployed.
Figure 8:
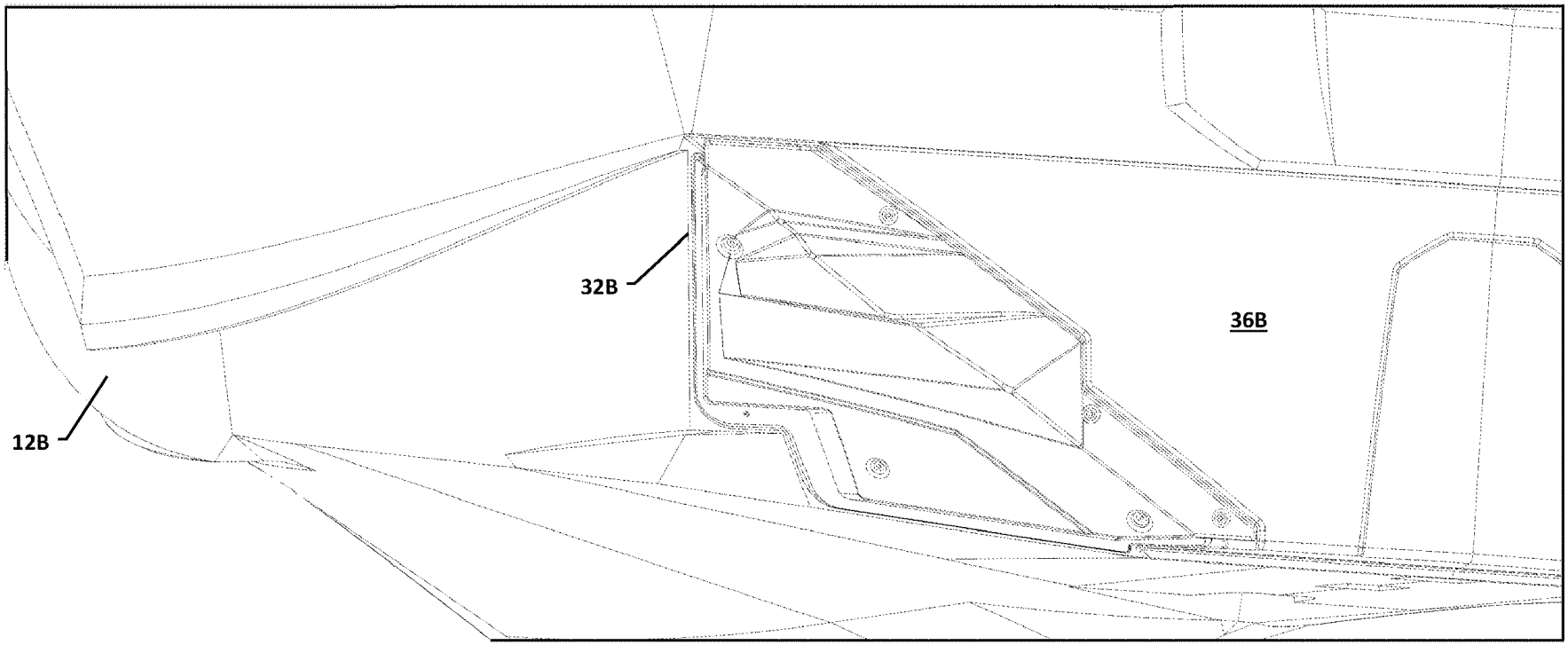
FIG. 8 is a rear quarter view of the watersports boat hull of FIG. 5, with the plate of the surf system retracted.

Referring to FIGS. 6 and 7, the controller 56 can also be configured with program instructions to automatically partially deploy both plates 52 beyond the rear corners 32A when the speed input 60 indicates speed in excess of an upper speed threshold. When the speed input 60 indicates speed has fallen below a lower speed threshold, the controller 56 is configured to fully retract both the plates 52 (as in FIG. 8), or resume normal surf system operation (as will be described in greater detail below).

The partial deployment of the plates 52 further enhances handling characteristics of the hull 12B at higher operating speeds. A preferred deployment length of the plates 52 past the corners 32B is less than ½ inch, and preferably approximately ¼ inch, although it will be appreciated that deployment length can be optimized for any given hull.

Figure 9A:
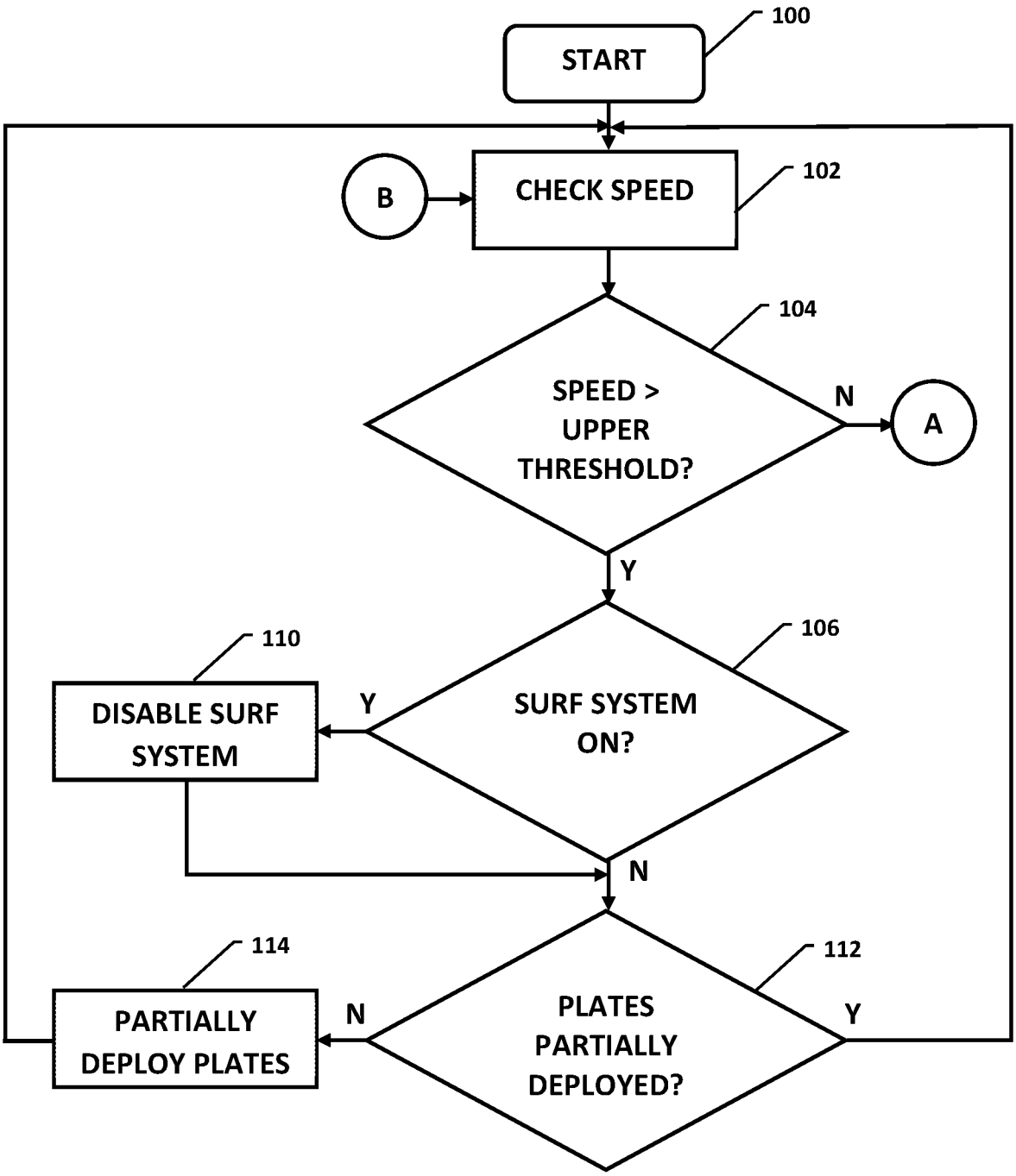

Referring to FIGS. 9A and 9B, an operational routine of the surf system 50 starts at 100. Speed is checked by the controller 56 via the speed input 60 at 102. At 104, the controller 56 determines whether speed is in excess of an upper threshold. If the speed is in excess of the upper threshold (e.g., 14 knots), the controller 56 determines whether the surf system 50 is on (i.e., deployed as described above for surfing) at 106. If the surf system 50 is on, normal operation is disabled at 110.

If the surf system 50 is not on, or after disabling normal surf system operation, the controller 56 determines if the plates are partially deployed at 112. If not, then the controller 56 operates the plate drivers 54 to automatically partially deploy both plates 52 at 114. If the plates are already partially deployed, or after partial deployment, the controller 56 repeats the routine by re-checking speed at 102.

If speed is not above the upper threshold at 104, the controller 56 determines if speed is below a lower threshold (e.g., 13 knots) at 116. If speed is not below the lower threshold, the controller 56 repeats the routine by re-checking speed at 102. The use of a control band between upper and lower thresholds helps eliminate hunting. It will be appreciated that the size of the control band and the thresholds can be optimized for a given surf system and boat hull.

If speed is below the lower threshold at 116, the controller 56 determines whether the plates 52 are partially deployed at 120. If the plates 52 are not partially deployed, the controller 56 repeats the routine by re-checking speed at 102. If the plates are partially deployed at 120, then the controller 56 determines at 122 whether the surf system 50 was previously turned on (i.e., turned on by the operator, but disabled at 110 per an earlier iteration of the routine).

If the surf system 50 was previously turned on, then the controller 56 resumes normal surf system 50 operation at 124—typically by using the drivers 54 to fully retract the plate 52 on the non-selected side and fully extend the plate 52 on the selected side. If the surf system 52 was not previously turned, the controller 56 simply uses the plate drivers 54 to fully retract the plates 52 at 126. In either case, the controller 56 then repeats the routine by re-checking speed at 102.

It will be appreciated the foregoing steps of the control routine can be repeated in any logical order, that not all steps are necessarily required for every iteration of the control routine, and that additional steps could be added to iterations of the control routine. In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A watersports boat comprising:

a hull having a transom; and a surf system including a controller and plates extendable past rear corners on opposite sides of the hull adjacent the transom, each of the rear corners marking a distinct transition from a respective one of the sides of the hull to the transom;

wherein the controller is configured to partially extend both of the plates beyond the opposite sides of the transom;

wherein along an operating nominal water line region of the hull, a shape of an outer perimeter of the hull curves away from a hull centerline moving forwardly of the rear corners.

2. The watersports boat of claim 1, wherein the surf system further includes a speed input and the controller is configured to automatically partially extend both of the plates beyond the opposite sides of the transom when the speed input indicates speed in excess of an upper speed threshold.

3. The watersports boat of claim 2, wherein, when the speed input indicates the speed has fallen below a lower speed threshold, the controller is further configured to:

fully retract both the plates; or resume normal surf system operation with only one of the plates extended.

4. The watersports boat of claim 1, wherein a deployment length of the plates when partially deployed by the controller is less than ½ inch.

5. The watersports boat of claim 4, wherein the deployment length is ¼ inch.

6. The watersports boat of claim 1, wherein the plates extend past rear corners of the hull, each of the rear corners marking a distinct transition from a respective one of the sides of the hull to the transom.

7. The watersports boat of claim 1, wherein a length of each curve is greater than 8 inches.

8. The watersports boat of claim 7, wherein the length of each curve is greater than 18 inches.

9. The watersports boat of claim 8, wherein the length of each curve is between 20 to 21 inches.

10. A watersports boat offering improved wake scaling comprising:

a hull having an outer perimeter defining a first nominal waterline region corresponding to a nominal water line when the watersports boat is not in motion in water and a second nominal waterline region corresponding to the nominal water line when the watersports boat is moving forward through the water, the second nominal water line region separated from the first nominal water line region by an operating angle, and the hull having opposite sides each transitioning to a transom of the hull;

wherein a shape of the outer perimeter of the hull along the second nominal water line region includes a pair of outward curves, each outward curve curving away from a hull centerline moving forwardly of the transom.

11. The watersports boat of claim 10, wherein rear corners of the hull each define a distinct transition from a respective one of the opposite sides of the hull to the transom.

12. The watersports boat of claim 10, wherein each of the outward curves has a length, moving forwardly of the transom, of at least 8 inches.

13. The watersports boat of claim 12, wherein the length of each of the outward curves is at least 18 inches.

14. The watersports boat of claim 13, wherein the length of each of the outward curves is 20 to 21 inches.

15. The watersports boat of claim 10, wherein the operating angle is at least three degrees.

16. The watersports boat of claim 10, wherein the operating angle is in a range of 6-8 degrees.

17. The watersports boat of claim 10, wherein a length of each curve is greater than 8 inches.

18. The watersports boat of claim 10, wherein the length of each curve is greater than 18 inches.

19. The watersports boat of claim 10, wherein the length of each curve is between 20 and 21 inches.

* * * * *